United States Patent [19]

Mondini et al.

[11] Patent Number: 4,565,337

[45] Date of Patent: Jan. 21, 1986

[54] METHOD AND APPARATUS FOR FORMING A LAP

[75] Inventors: Giancarlo Mondini, Winterthur; René Schmid, Niederneunforn, both of Switzerland

[73] Assignee: Rieter Machine Works Limited, Winterthur, Switzerland

[21] Appl. No.: 657,613

[22] Filed: Oct. 4, 1984

[30] Foreign Application Priority Data

Oct. 12, 1983 [CH] Switzerland ..... 5561/83

[51] Int. Cl.[4] ..... B65H 17/08

[52] U.S. Cl. ..... 242/66; 242/75.51

[58] Field of Search ..... 242/66, 75.51, 75.1, 242/DIG. 3

[56] References Cited

U.S. PATENT DOCUMENTS

| | | | |
|---|---|---|---|
| 2,686,014 | 8/1954 | Strässler . | |
| 3,000,584 | 9/1961 | Clem | 242/66 |
| 3,568,944 | 3/1971 | Besserdich | 242/66 |
| 3,658,273 | 4/1972 | Chapuis . | |
| 3,937,410 | 2/1976 | Justus | 242/66 |
| 4,458,853 | 7/1984 | Heymanns | 242/66 X |

FOREIGN PATENT DOCUMENTS

| | | | |
|---|---|---|---|
| 2028647 | 12/1970 | Fed. Rep. of Germany . | |
| 2020283 | 11/1971 | Fed. Rep. of Germany | 242/66 |
| 346800 | 7/1960 | Switzerland . | |
| 991724 | 5/1965 | United Kingdom . | |

*Primary Examiner*—Stuart S. Levy
*Assistant Examiner*—Lloyd D. Doigan
*Attorney, Agent, or Firm*—Werner W. Kleeman

[57] ABSTRACT

A winding apparatus for forming laps has two winding rollers and on each side thereof a carrier arm for receiving a lap bobbin. Each carrier arm is pivotably connected on one end with a sliding guide and on the other end with a pivoting mechanism. A hinge joint and a pivot pin provide these pivotal connections. The pivot mechanism is pivotally supported in side walls of the apparatus by shafts. The pivotal movement is accomplished by a pressure air cyclinder. During pivoting of the pivoting mechanism about the shafts the carrier arms are shifted in a predetermined direction. In FIG. 1, the lowermost position of the therein depicted carrier arm is shown in which the lap bobbin rests on the winding rollers. Through rotation of the winding rollers the lap bobbin rotated and takes up a web delivered from calender rollers for the formation of a lap. The build-up of the lap causes lifting of the carrier arms in such predetermined direction. To produce a predetermined contact pressure between the lap and the winding rollers, a pressure controlled by a pressure reducing valve is built-up in the pressure air cylinder. To controllably reduce this air pressure in the pressure air cylinder the pressure reducing valve is controlled by a control rule. This control rule is connected with the sliding guide and simultaneously moves with and in the same direction as the carrier arms. Through the control of the air pressure by the control rule the advantage is obtained that the contact force between the lap and winding rollers is controllable such that the contact pressure can be held substantially constant during building-up of the lap.

6 Claims, 4 Drawing Figures

METHOD AND APPARATUS FOR FORMING A LAP

BACKGROUND OF THE INVENTION

The present invention relates to a new and improved method of, and an apparatus for, forming a lap.

Generally speaking the method for forming a lap contemplates rolling of a lap bobbin or the lap formed thereon upon two drivable and rotatable winding rolls or rollers carrying the lap bobbin or the lap formed on the lap bobbin, the bobbin or the lap, as the case may be, being pressed with a predetermined force against the winding rollers.

The winding apparatus for the formation of laps is of the type comprising two drivable and rotatable winding rollers for the frictional rotation of a lap bobbin or the lap to be formed on the lap bobbin, and further contains movable carrier arms located on both sides of the winding rollers for receiving or supporting the lap bobbin or the thereon formed lap. Drive means move the carrier arms with a predetermined force directed against or opposite to the increasing size of the lap and in accordance with the increase in the size of the lap.

Laps serve as feed material for ribbon lap machines and for the succeeding combing process.

In order to obtain good results in the ribbon lap machine and in the combing process it is essential that the lap not only has an even or uniform web, but also that the lap density is substantially constant from lap to lap. In order to obtain a lap of adequate density, the lap must be pressed against the winding rollers which support the lap. This is achieved in that a force is exerted on the wind-assisting means receiving the lap, the force being exerted in an appropriate direction and being caused by appropriate means.

Basically, the lap bobbins are supported by shafts inserted into both opposite ends of the lap bobbin. It is known from the prior art that a force produced by a respective pneumatic cylinder is exerted upon each of the two shafts in order to obtain the previously mentioned lap density. The pneumatic cylinders are subjected to a constant pressure produced by a pressure regulating valve, so that the force exerted on the shafts remains constant during the entire formation of the lap.

A second way of exerting the above-mentioned force on the shafts consists in using racks instead of pneumatic cylinders, these racks being joined to shaft supports or bearings guided in sliding guides. These racks produce the force corresponding to the pressure cylinders by means of a gear wheel transmission meshing with the racks.

These arrangements have the disadvantage that due to the constant pressing force acting over the entire period of lap formation, the lap experiences a declining contact pressure as a result of the increasing contact surface of the lap on the winding rollers. This produces a constantly declining density of the lap.

SUMMARY OF THE INVENTION

Therefore it is a primary object of the present invention to provide an improved method and apparatus for forming a lap in a manner not afflicted with the aforementioned drawbacks and shortcomings of the prior art.

A further important object of the present invention is direction to an improved method and apparatus for forming a lap wherein there is obtained a substantially constant contact pressure at each layer of the lap during building-up of the lap.

Another important object of the present invention is to provide an improved method and apparatus for obtaining a substantially constant density of the formed lap.

Still a further significant object of the present invention aims at providing an improved apparatus for forming a high quality lap which is relatively simple in construction and design, highly reliable in operation, quite economical to manufacture, not readily subject to breakdown or malfunction, and requires a minimum of maintenance and servicing.

Now in order to implement these and still further objects of the invention, which will become more readily apparent as the description proceeds, the lap forming method of the present development is manifested by the features that the aforementioned force is controlled in such a manner that the contact pressure arising in the contact surfaces of the bobbin or the thereon formed lap on the winding rollers is controllable.

As alluded to above the invention is not only concerned with the aforementioned method aspects but also pertains to an improved lap forming apparatus wherein, according to the invention, there is provided a control means for controlling the drive means so that the aforementioned force is variable.

One of the more notable advantages achieved by the invention consists in attaining an essentially constant contact pressure at each layer of the lap during building-up of the lap.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
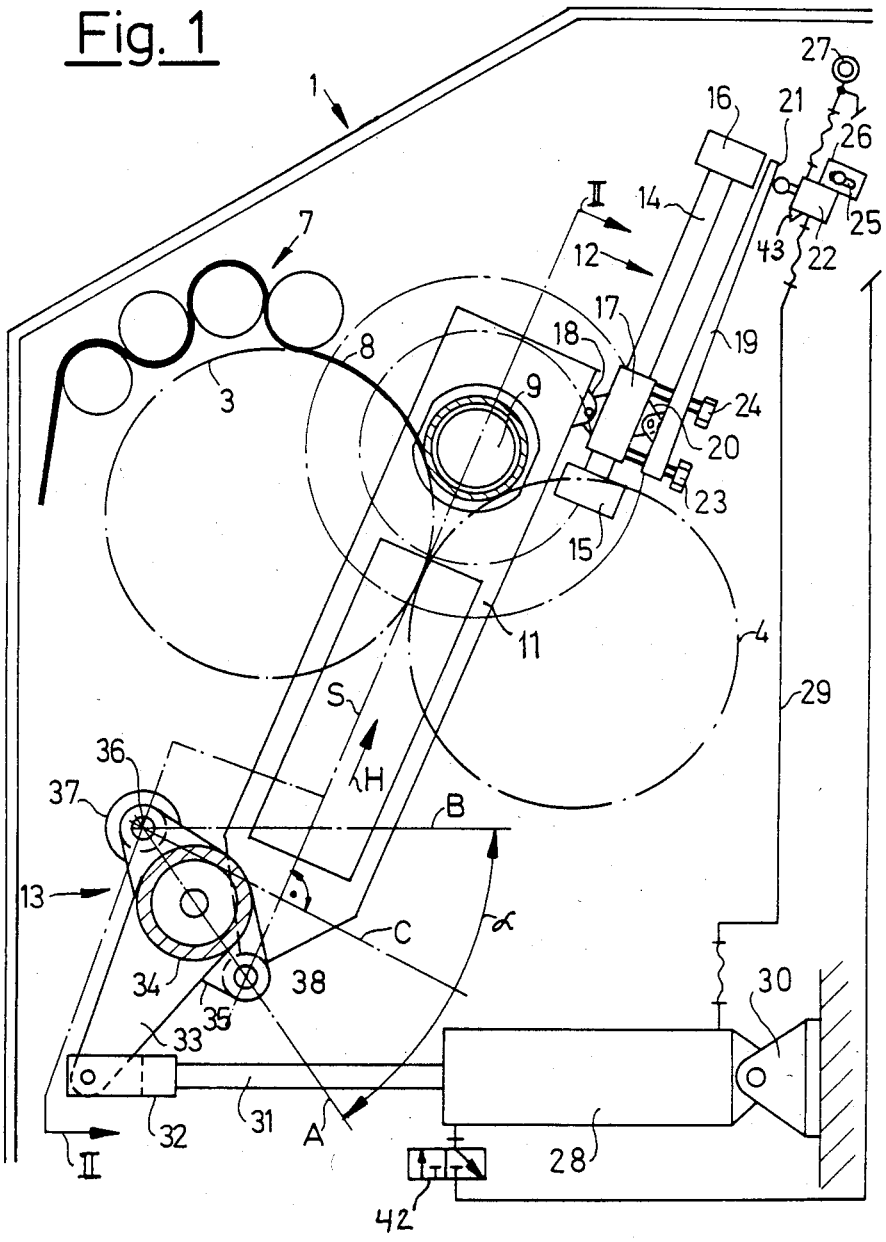
FIG. 1 shows in partial schematic illustration a section through the lap forming apparatus according to the invention, taken substantially along the line I—I of FIG. 2.
Figure 2:
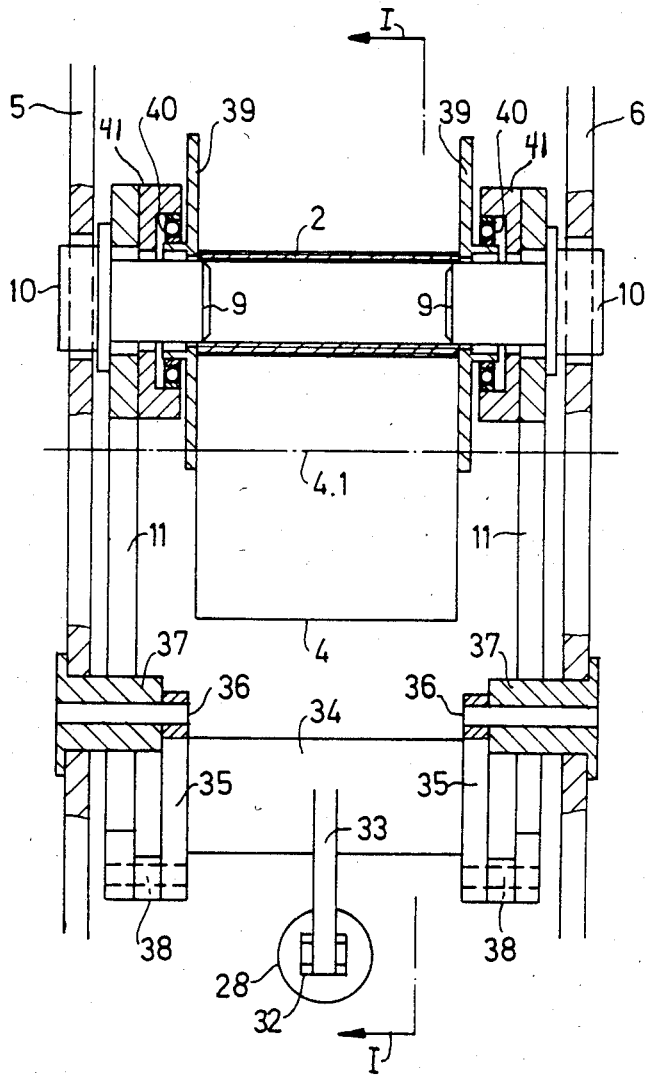
FIG. 2 shows in partial schematic illustration a partial section through the lap forming apparatus of FIG. 1, taken substantially along the line II—II of FIG. 1.

Describing now the drawings, it is to be understood that for purposes of simplifying the illustration thereof only enough of the details of the construction of the lap forming apparatus have been shown as needed for those skilled in the art to readily understand the underlying principles and concepts of the present invention. Turning attention now to FIG. 1, there is illustrated therein an apparatus 1 for forming a lap (indicated in FIG. 3 in various increasing sizes with the reference characters L, M and N) on a lap bobbin 2 and which comprises two rotatable and drivable winding rollers or rolls 3 and 4 (only one being illustrated in FIG. 2) for receiving the lap bobbin 2 or the lap. These winding rollers 3 and 4 are appropriately drivable by any suitable and conventional drive means and are also appropriately rotatably supported, with their lengthwise axes substantially in parallelism, in side walls 5 and 6 of the apparatus 1. In FIG. 2, for simplicity, the rotatability of the winding rollers 3 and 4 is only schematically indicated by the geometrical rotational axis 4.1 of the winding roller 4. Due to the rotation of the winding rollers 3 and 4, the lap bobbin 2 resting thereon is set into rotation and thereupon takes up the web 8 delivered by the calender rolls or rollers 7 to form the lap.

This lap bobbin 2 is supported on both sides or its opposite ends by respective pistons 9 of fluid-operated, for instance pneumatic cylinders 10 extending into the lap bobbin 2 and thereby forming the shafts receiving and supporting the lap bobbin 2. Each pneumatic cylinder 10 is, in turn, secured to a related carrier arm 11. Further, on each side or end of the winding rollers 3 and 4 there is provided a disk or plate member 39 for guiding the lap coaxially with respect to the pistons 9. Each disk 39 is rotatably mounted by means of a roller bearing 40 which is received in a related bearing housing 41 forming part of the associated carrier arm 11.

As seen from FIG. 1, the carrier arms 11 provided on both sides or ends of the winding rollers 3 and 4 are each pivotably secured at their upper ends to a sliding guide or guide member 12 and at their lower ends to a pivot mechanism 13. Each sliding guide 12 comprises a slide rail 14 which is held at both ends by a carrier or support member 15 and 16, respectively. These carriers or support members 15 and 16 are secured at one side or end to the side wall 5 and at the other side or end to the side wall 6. The slide rail or rail member 14 serves to receive a sliding element 17 to which the related carrier arm 11 is pivotally connected by means of a hinge or pivot joint 18. On the side of the sliding or slide element 17 associated with one of the carrier arms 11 as shown in FIG. 1, and which side lies opposite the hinge joint 18, there is arranged a control rule or linear element 19, defining a control cam, which is also pivotally secured to this slide element 17 by means of a hinge or pivot joint 20.

The control rule 19 has a control or cam surface 21 by means of which a known, commercially available pressure reducing valve 22 is controlled. In order to fix the position of the control rule 19 in a selected region, adjustment or positioning screws 23 and 24 are located at opposite sides of the hinge or pivot joint 20. Furthermore, the pressure reducing valve 22 is also movably secured to a suitable support (not shown) forming part of the side wall 5 by means of a holder 26 provided with a slot 25 and associated with the pressure reducing valve 22.

This pressure reducing valve 22 is fed with pressurized air from a suitable source 27 of such pressurized air and delivers an air pressure adapted to requirements by means of an air lead or line 29 to a double-acting pneumatic cylinder 28. This double-acting pressure or pneumatic cylinder 28 is pivotally supported on one side or end at a stationary support 30 forming part of the lap forming apparatus 1.

On the other side or end, a piston head 32 forming part of the piston 31 of the pneumatic cylinder or cylinder unit 28 is also pivotally connected with a lever or lever member 33 forming part of the pivot mechanism 13.

The lever 33, in turn, is an element or part of an intermediate portion 34 which is provided at both of its ends with a flange 35.

By means of each of these flanges 35 the pivot mechanism 13 is pivotally connected, on the one hand, by means of a related shaft 36 with an associated support element 37, each of which is fixedly secured in one of the side walls 5 and 6, respectively, and, on the other hand, by means of a related pivot pin 38 with the associated carrier arm 11. The position of pivot mechanism 13 is such that during upward movement of the carrier arms 11, in the direction H (FIG. 1) out of the lowermost position of the carrier arm 11 illustrated in such FIG. 1 into a non-illustrated uppermost position, the pivot mechanism 13 pivots out of the position indicated with the angle defining or boundary line A into the position indicated by the angle defining or boundary line B.

The angle defining or boundary line A lies in an imaginary plane containing the geometrical rotation axis of the shaft 36 and of the pivot pin 38 and furthermore these two angle boundary lines A and B define or enclose therebetween the angle $\alpha$.

The position of the pivot mechanism 13 is further characterized in that the line C bisecting the angle $\alpha$ intersects the axis of symmetry S of the carrier arm 11 depicted in FIG. 1 located in its lowermost position at a right angle or, in other words, at an angle of 90°, wherefrom it follows that the axis of symmetry S of the carrier arm 11 located in its lowermost position aligns with the axis of symmetry of such carrier arm 11 located in its uppermost position.

It should also be mentioned that in the lowermost position of the carrier arms 11 the lap bobbin 2 rests on the winding rollers 3 and 4 and in the uppermost position of the carrier arms 11 the full lap (indicated by reference character N in FIG. 3) likewise rests on the winding rollers 3 and 4.

For the control system described in the following the basic rule applies that the contact pressure at the contact surfaces between the forming lap K to N (FIG. 3) and the winding rollers 3 and 4 should follow a controlled function or pattern.

Figure 3:
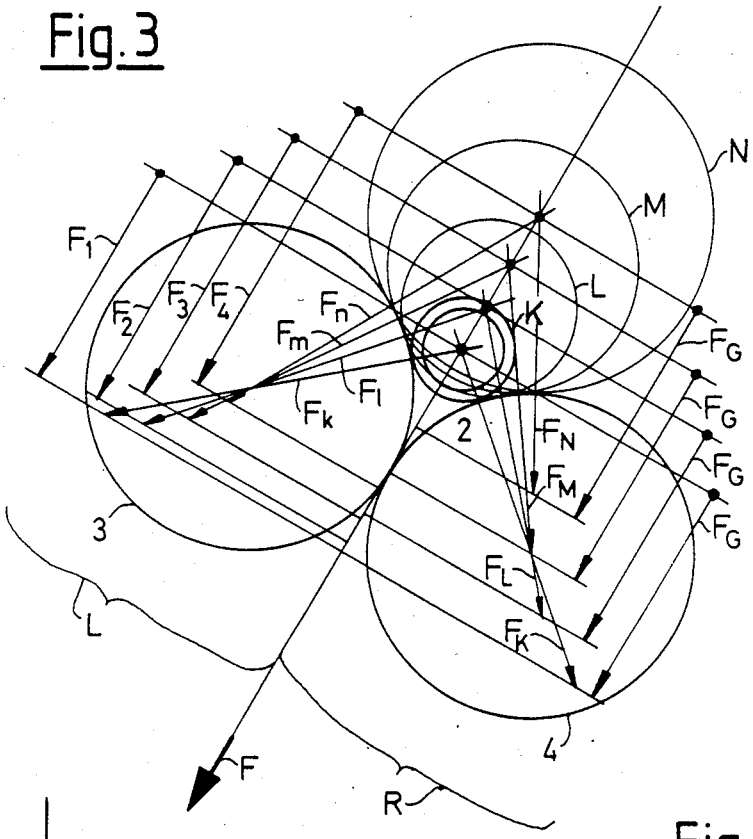
FIG. 3 is a representation of the forces prevailing in the lap forming apparatus according to the invention.
Figure 4:
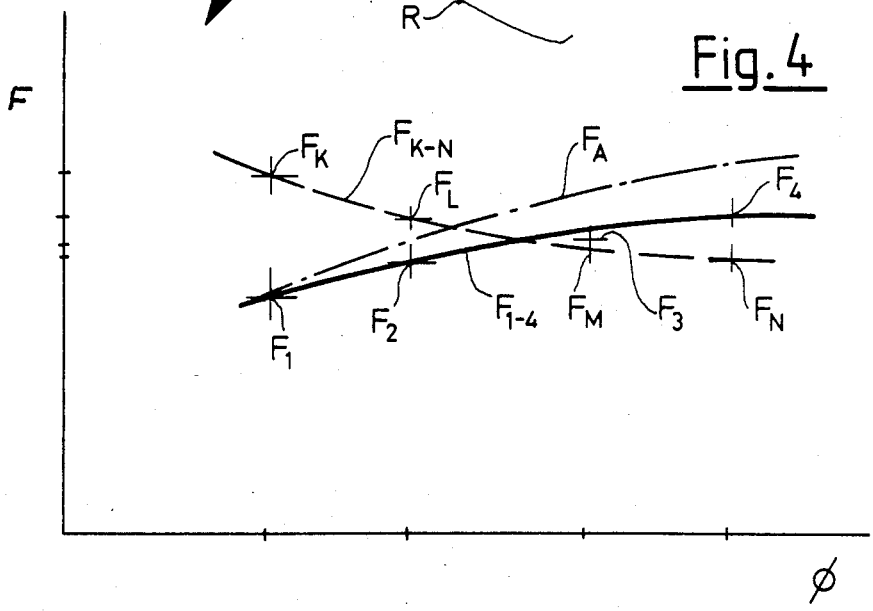
FIG. 4 is a representation in the form of a graph of the forces of FIG. 3.

This function is explained with the aid of FIGS. 3 and 4. FIG. 3 shows the winding rollers 3 and 4 with the lap bobbin 2 and indicates with the circles L, M and N the growing lap.

Further, FIG. 3 shows in the right-hand portion indicated by reference character R, that is at the region to the right of the force direction F of the carrier arm 11, the force conditions on the assumption that the force F remains constant during the entire time of the build-up of the lap, which is represented by the constant length of the force-arrows FG representing corresponding forces FG.

The force FG is equal to half of the force produced by both carrier arms 11, and thus corresponds to the force produced by one carrier arm.

From the force triangles it can be seen that with this assumption or prerequisite the contact forces FK to FN reduce with increasing lap diameter from K to N. For FIG. 3, the contact force is to be understood as that force which is produced in the contact surface of the bobbin 2 or of the lap on the winding roller 4.

In the portion of FIG. 3 indicated with reference numeral L, that is at the region to the left of the force direction F, those changes of the force conditions are shown which arise on the assumption that the contact forces Fk to Fn are the same, that is are constant during the entire time of the build-up of the lap, and correspondingly the force F of the carrier arm 11 increases as shown by the force arrows $F_1$, $F_2$, $F_3$ and $F_4$.

The force function of the forces FK to FN is represented in FIG. 4 with the characteristic $F_{K-N}$ and the force function of the forces $F_1$–$F_4$ is represented with the characteristic $F_{1-4}$, the force F being represented by the ordinate and the lap diameter $\phi$ by the abscissa.

Characteristic $F_{1-4}$ takes account of the fact that the contact forces should remain constant despite the growing lap, but does not yet take account of the fact that the contact pressure between the winding rollers and laps of varying diameter should remain constant.

It is known that with a growing lap the contact surfaces of the lap on the winding roller become larger, so that with constant contact force the surface pressure (also called specific surface loading measured in Newton/$m^2$) reduces proportionally to the increase in the contact surfaces.

Now, in order to hold the surface pressure constant with an increase in the contact surfaces, the force F must be adapted, which is indicated by the characteristic $F_A$.

In order to achieve the force function of force F indicated by the characteristic $F_A$, the pressurized or compressed air delivered by the pressure air or pneumatic cylinder 28 must, as indicated in FIG. 1, be correspondingly controlled by means of the control rule 19, that is to say by means of its control surface 21, in other words this control surface 21 is appropriately formed or structured.

The form or shape of this control surface 21 must also additionally contain the correction which compensates the change in the force effect of the pneumatic cylinder 28 caused by the pivotal movement of each pivotable lever 33 and of the pivot mechanism 13.

Since the change in the contact surface is an empirical quantity dependent upon the machine design, the form of the control surface 21 must be determined by experiment.

In order to be able to make the control function variable over a predetermined range notwithstanding the fixing of the control surface 21, the control rule 19 is, as already mentioned, pivotable by means of a hinge or pivot joint 20 and can be fixedly held by means of the adjustment screws 22 or equivalent structure. Upon adjustment of the position of the control rule 19, the position of the pressure reducing valve 22 must also be correspondingly adjusted which is possible through the type of mounting of the pressure reducing valve 22 containing the slot 25. Finally, the pressure air or pneumatic cylinder 28 is connected at the end directed towards the piston 31 with a so-called 3/2-way valve 42 (with a block-0-position), which is in the 0-position indicated in FIG. 1 during building-up of the lap.

During formation of the lap, the carrier arms 11 are lifted in the direction H as a result of the increasing lap diameter, the piston 31 thereby being pushed into the pneumatic cylinder 28.

This inward movement of the piston 31 produces in that portion of the pneumatic cylinder 28 connected with the pressure air lead or line 29 an air pressure which may or should have a defined value in dependence upon the desired contact force $F_A$. For example, if the air pressure demand corresponding to the largest contact force $F_A$ is less than the air pressure built-up by the movement of the piston 31, then the controlled pressure reducing or reduction valve 22 must release the pressure in the pressure air lead or line 29 via a vent 43 forming part of the pressure reducing valve 22.

On the other hand, if, corresponding to the largest contact force $F_A$, an air pressure is required which is greater than the air pressure produced by the movement of the piston 31, then the pressure reducing valve 22 must be controlled so that an additional pressure is built-up in the pressure air lead or line 29.

The foregoing will be explained based upon the following Examples:

(a) When the bobbin 2 rests on the winding rollers 3 and 4 a pressure of, for instance, 1.5 bar is necessary; correspondingly the pressure reducing valve 22 provides a pressure of 1.5 bar.

(b) Through the movement of the piston 21, in the end position produced by the largest lap diameter, there would arise a pressure of, for instance, 4.5 bar when the pressure air lead 29 is assumed closed off.

(c) If, in the end position of the piston 31 defined by the largest lap diameter, a pressure of only 3.5 bar is required, then the pressure reducing valve 22 must be so controlled that the pressure in the lead 29 is regulated via the vent 43.

(d) If, however, in the end position of the piston 31 defined by the largest lap diameter, a pressure of, for instance, 5.5 bar is required, then the pressure reducing valve 22 must be so controlled that the vent 43 remains closed and a gradual pressure increase takes place in the pressure air lead 29.

In order to release the completed lap finally from the contact force, the 3/2-way valve 42 is switched so that the full pressure of the pressure air source 27, for example 10 bar, pushes the piston 31 fully into its final position in the pressure air or pneumatic cylinder 28.

After the removal of the finished lap—with withdrawn pistons 9 (the corresponding control for which is not particularly shown)—the carrier arms 11 are brought into an intermediate position which is not essential to the understanding of the invention and is therefore not described, in which position the bobbin 2 layed on the winding rollers 3 and 4 can be grasped by the pistons 9 inserted into the new bobbin 2 in the absence of the contact force $F_A$.

While there are shown and described present preferred embodiments of the invention, it is to be distinctly understood that the invention is not limited thereto, but may be otherwise variously embodied and practiced within the scope of the following claims. Accordingly,

What we claim is:

1. A method for forming a lap comprising the steps of:

rolling a lap bobbin or the lap formed thereon on two drivable and rotatable winding rollers carrying the bobbin or the lap;

pressing the bobbin or the lap with a predetermined force against the winding rollers;

controlling said force in such a manner that the contact pressure arising in contact surfaces of the bobbin or the lap on the winding rollers is controllable; and controlling the force such that the contact pressure remains substantially constant; and increasing the contact force with increasing build-up of the lap such that the contact pressure remains substantially constant at each layer of the formed lap.

2. A winding apparatus for formation of laps comprising:

two drivable and rotatable winding rollers for frictional rotation of a lap bobbin or the lap to be formed thereon;

movable carrier arms arranged on both sides of the winding rollers for supporting the lap bobbin or the lap formed thereon;

drive means for moving the carrier arms with a predetermined force directed against the increasing size of the lap and corresponding to the increase in the size of the lap;

control means for controlling the drive means such that said predetermined force is variable; and said control means controls the drive means in such a manner in dependence upon the diameter of the lap that a contact pressure arising between the bobbin or the lap formed thereon and the winding rollers remains substantially constant; and said control means controlling the drive means such that said predetermined force directed against the lap increases with increasing size of the lap so that said contact pressure remains substantially constant at each layer of the formed lap.

3. The winding apparatus as defined in claim 2, wherein:

said drive means comprises a pressure air cylinder; and said control means comprises a control element movable by means of one of the carrier arms and a pressure adjusting means controlled by said control element.

4. The winding apparatus as defined in claim 3, wherein:

said control element comprises a control rule connected with said one carrier arm and having a control surface; and the pressure adjusting means comprises a pressure reducing valve which is operated by said control surface such that said force increases as the lap becomes larger.

5. The winding apparatus as defined in claim 4, wherein:

the control surface is structured such that by means of a force developed by the pressure air cylinder said contact pressure remains substantially constant as the lap becomes larger.

6. The winding apparatus as defined in claim 4, wherein:

said control rule and the pressure reducing valve are each adjustably arranged such that a force developed by the pressure air cylinder is adjustable within a predetermined range.

* * * * *

UNITED STATES PATENT AND TRADEMARK OFFICE

CERTIFICATE OF CORRECTION

PATENT NO. : 4,565,337

DATED : January 21, 1986

INVENTOR(S) : GIANCARLO MONDINI et al

It is certified that error appears in the above—identified patent and that said Letters Patent is hereby corrected as shown below:

Column 5, line 10, please delete "$F_{1-4}$" and insert --$F_{1-4}$,--

Column 5, line 28, please delete "$F_A$" and insert --$F_A$,--

Column 6, line 7, please delete "$F_A$" and insert --$F_A$,--

Signed and Sealed this

*Fifteenth* Day of *April 1986*

[SEAL]

*Attest:*

DONALD J. QUIGG

*Attesting Officer*

*Commissioner of Patents and Trademarks*